US005518487A

United States Patent [19]

Hallmark

[11] Patent Number: 5,518,487

[45] Date of Patent: May 21, 1996

[54] EXERCISE APPARATUS

[76] Inventor: Timothy M. Hallmark, 2799 Kuykendall, Bellville, Tex. 77418

[21] Appl. No.: 298,460

[22] Filed: Aug. 30, 1994

[51] Int. Cl.[6] ..... A63B 26/00

[52] U.S. Cl. ..... 482/140; 482/142; 482/141

[58] Field of Search ..... 482/140, 142, 482/91, 95, 96, 104, 145, 141

[56] References Cited

U.S. PATENT DOCUMENTS

| | | | |
|---|---|---|---|
| 4,198,044 | 4/1980 | Holappa | 482/142 |
| 4,537,395 | 8/1985 | Spinelli | 482/104 |
| 4,746,114 | 5/1988 | Grider . | |
| 4,826,157 | 5/1989 | Fitzpatrick | 482/142 |
| 4,871,166 | 10/1989 | Sterba et al. . | |
| 4,953,857 | 9/1990 | Lemire | 482/104 |
| 4,968,029 | 11/1990 | Cossin | 482/142 |
| 5,125,884 | 6/1992 | Weber et al. . | |
| 5,160,305 | 11/1992 | Lin . | |
| 5,176,603 | 1/1993 | Hundley et al. . | |
| 5,190,513 | 3/1993 | Habing et al. . | |

*Primary Examiner*—Lynne A. Reichard
*Attorney, Agent, or Firm*—Fish & Richardson

[57] ABSTRACT

An exercise apparatus for performing abdominal and lower back exercises has a base having an upwardly extending support bar affixed to one end of the base. A bench having a foot end and a head end, is pivotally connected at its foot end to the upwardly extending support bar. A feet restraining means, an upper torso support means, and an overhead hand grip are removably attached to the bench. A bench height positioning means, including a maximum decline and a maximum incline point is located on the base. A bench height adjustment bar is pivotally connected to the bench, wherein the bench height adjustment bar may be engaged in the position adjustment means for positioning the bench in multiple positions, including declining, horizontal, and inclining exercise positions.

13 Claims, 7 Drawing Sheets

EXERCISE APPARATUS

FIELD OF THE INVENTION

The present invention relates to the field of exercise apparatuses, and particularly to an apparatus for performing abdominal and lower back exercises.

BACKGROUND OF THE INVENTION

Numerous exercise apparatuses have been developed for exercising various parts of the body. For example, adjustable bench assemblies designed for use with a variety of basic exercise apparatus devices, as disclosed in U.S. Pat. No. 4,746,114, Grider, May 24, 1988, enable positioning a bench so that the exerciser may be in a reclining or sitting position when performing various exercises using weights. U.S. Pat. No. 5,160,305, Lin, Nov. 3, 1992, discloses a multi-functional exercise apparatus with an adjustable bench having a semi-circular set plate on the front edge of the main body of the apparatus so that an exerciser can optionally secure various exercise attachments, such as a peddle assembly, a weighted leg lift assembly, or a situp support, depending upon the particular exercise requirements. Such exercise apparatuses are bench-type apparatuses designed to rely upon weights, cables, or other means to provide resistance to an exerciser's movements, and are costly and complicated to use. Moreover, such apparatuses focus on large muscle exercise and do not accommodate exercising abdominal and lower back muscles. Exercising abdominal and lower back muscles is critical to preventing back injury and maintaining proper spine position in order to minimize the potential for chronic back pain due to misalignment of the spine as a result of inadequate muscle support.

U.S. Pat. No. 4,871,166, Sterba et al., Oct. 3, 1989, discloses a sectionalized interlocking weight lifting exercise bench system that can be adjusted to place the bench pad surface in various spacial positions, in terms of the bench pad height and angle of incline and decline, for performing various weight lifting exercises and situps. The apparatus accommodates the performance of situps to exercise abdominal muscles, however, it does not enable an exerciser to exercise lower back muscles which are antagonistic to the abdominals, and should also be exercised when exercising the abdominals. U.S. Pat. No. 5,176,603, Hundley et al., Jan. 5, 1993, discloses an exercise board having an adjustable seat which may be angularly adjusted with respect to the base and the bench pad. When the seat is parallel with the base, the bench can be used to perform various exercises such as situps, which require an inclined position. U.S. Pat. No. 5,125,884, Weber et al., Jun. 30, 1992, discloses an adjustable bench exercising and rehabilitation apparatus. The bench has a hoisting device for raising and lowering the bench about a pivot point. The bench makes it possible for exercisers as well as rehabilitating or handicapped persons to perform abdominal exercises on an easy to position or reposition incline bench. The least resistance to exercise will be when the bench is in a position parallel to the ground. The bench cannot, however, be used in a declining position to further assist persons who are handicapped or rehabilitating and are not yet able to overcome any resistance to exercise or movement of the abdominal muscles. The bench is also not suitable for exercising lower back muscles.

Simple apparatuses are available for exercising either abdominal muscles or lower back muscles without using weights or resistance other than the exercisers weight include standard inclined benches for performing situps. The difficulty of the exercise may be adjusted by adjusting the angle of inclination. Apparatuses which allow an exerciser to incline at a 45° angle against a thigh support pad with feet held in place are available for performing hyperextensions to exercise lower back muscles are also available.

A dual-purpose exercise apparatus for exercising the abdominal muscles and lower back muscles where the only resistance to movement is an exercisers own weight is disclosed in U.S. Pat. No. 5,190,513, Habing et al., Mar. 2, 1993. The apparatus is comprised of front and rear incline portions extending downwardly from an apex. An exerciser can perform both abdominal and hyperextension exercises. It can not, however, be used to perform hip rotations, torso turns, or various other exercises which strengthen and improve the flexibility of the lower back and/or abdominal muscles. And as with other exercise apparatuses of its type, it can not be positioned to allow an exerciser to exercise abdominal muscles while in a declining position, as is often needed by persons recovering from injuries or persons beginning an exercise program after a long period of inactivity.

The disadvantages and shortcomings of the exercise apparatuses available for exercising abdominal and lower back muscles create a need for a single exercise apparatus which enables an exerciser to perform both abdominal and lower back exercises, and which relies upon the weight of the exerciser's body and gravity to provide resistance to exercise movements and can be adjusted from incline to decline positions to accommodate the exercise ability of top athletes as well as persons beginning an exercise program or rehabilitating from an injury.

SUMMARY OF THE INVENTION

An exercise apparatus for exercising both abdominal and lower back muscles without the use of weights or resistance to movement other than that of the exercisers own body weight is disclosed. The present invention is suitable for use by athletes training to increase performance levels and by persons beginning an exercise program or recovering from an injury.

The exercise apparatus for performing abdominal and lower back exercises has a base having an upwardly extending support bar affixed to one end of the base. A bench having a foot end and a head end, is pivotally connected at its foot end to the upwardly extending support bar. A feet restraining means, an upper torso support means, and an overhead hand grip including a pair of handles are removably attached to the bench. The feet restraining means may comprise a pair of foot cups. The upper torso support means may comprise a first and second upper torso support. In the preferred embodiment of the present invention, a strap for securing an exercise's feet is located near the head end of the bench.

A bench height positioning means, including a maximum decline and a maximum incline point is located on the base. A bench height adjustment bar is pivotally connected to the bench, wherein the bench height adjustment bar may be engaged in the position adjustment means for positioning the bench in multiple positions, including declining, horizontal, and inclining exercise positions.

In the preferred embodiment, the base is I-shaped. It is preferred that the apparatus includes a means, such as a plurality of rollers, for rolling the apparatus when moving it. A securing means, for example, a cable secures the bench to the base.

DETAILED DESCRIPTION OF THE INVENTION

Figure 1:
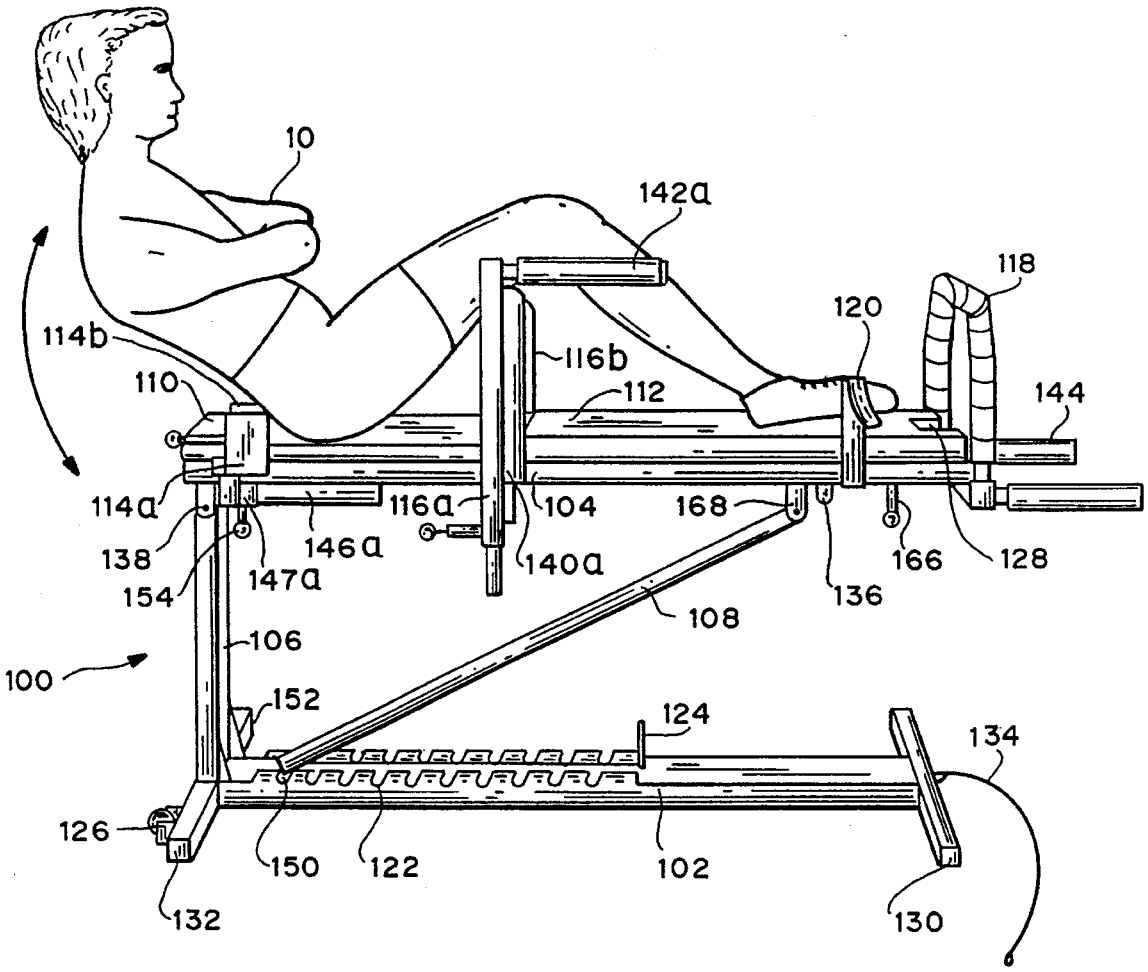
FIG. 1 is a perspective view of the preferred embodiment of the present invention, illustrating its use for performing abdominal exercises.
Figure 5:
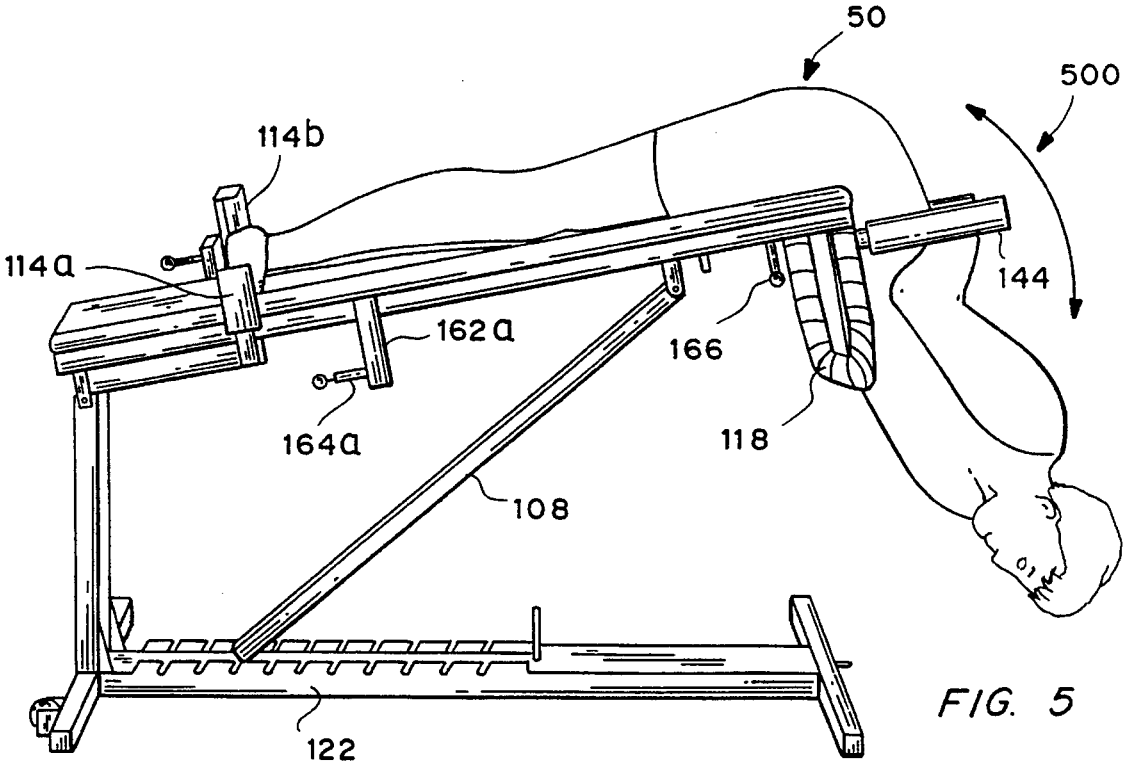
FIG. 5 is a perspective view of the present invention, illustrating its use for performing lower back exercises.

An exercise apparatus 100 according to the present invention is shown generally in FIG. 1. The apparatus comprises a base 102 having an upwardly extending support bar 106 affixed to one end of the base at 152. A bench 104 is pivotally connected at hinge 138 to the upper end of upwardly extending support bar 106. The end of bench 104 connected to upwardly extending support bar 106 is the foot end of the bench. The opposite end of the bench is the head end of the bench. Hinge 138 may be a simple bolt hinge or other hinge known to those skilled in the art. A first bench pad 110 and a second bench pad 112 are removably affixed to bench 104. Bench pads 110 and 112 are removably attached to bench 104 by screws or other means known to those skilled in the art. In the preferred embodiment of the present apparatus, bench pad 112 will have an approximately 4 inch by 4 inch cut out 128. Cut out 128 increases the comfort of male exercisers when performing lower back exercises as shown in FIG. 5. In an alternate embodiment of the invention, a single bench pad may be affixed to bench 104.

Figure 2:
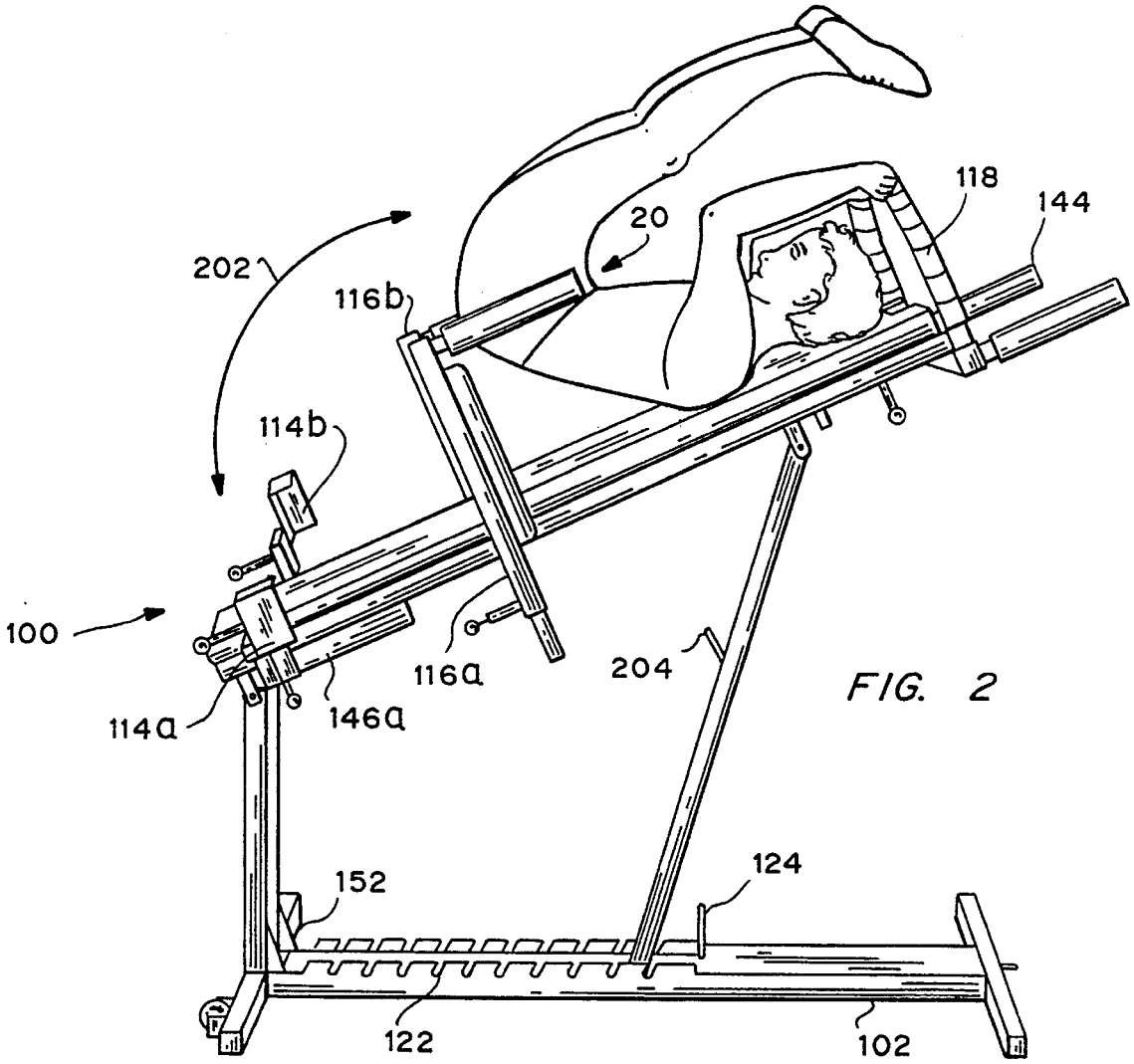
FIG. 2 is a perspective view of the preferred embodiment of the present invention, illustrating its use for performing abdominal exercises.
Figure 4:
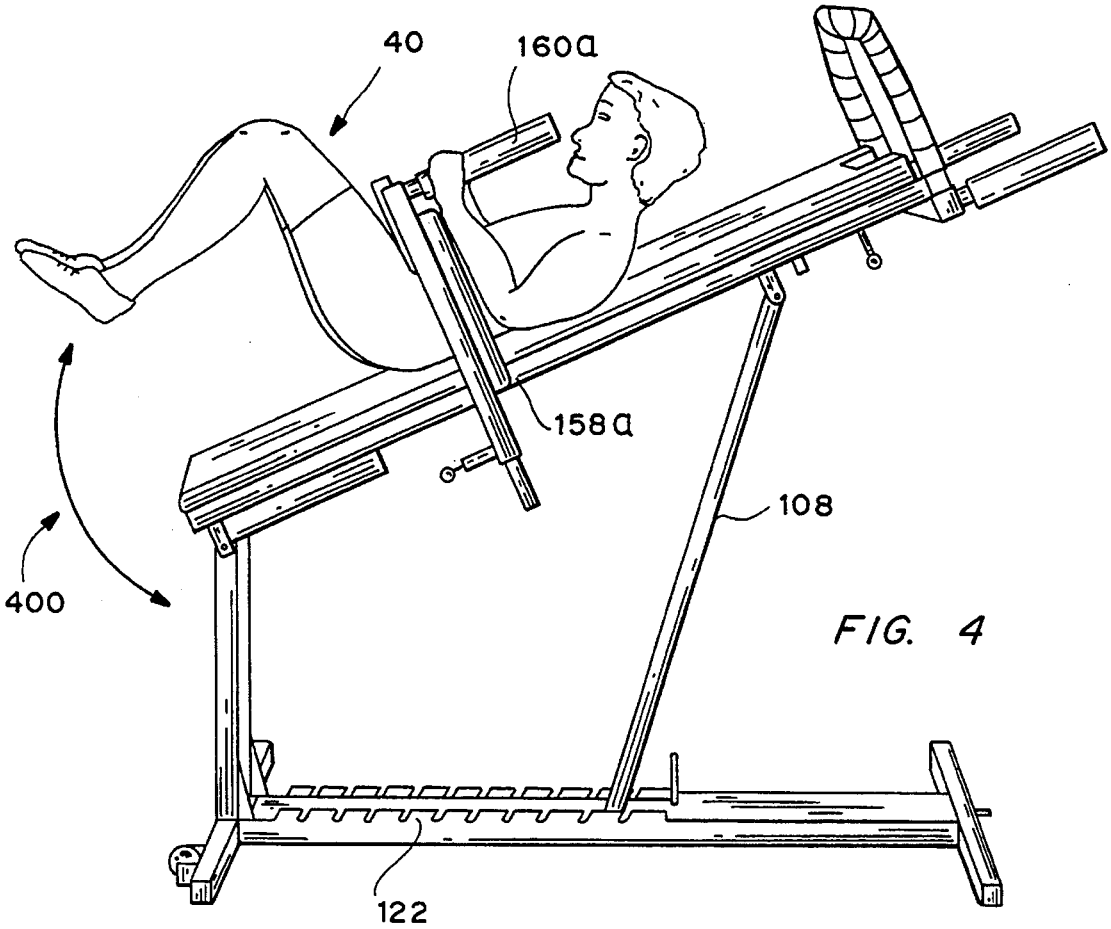
FIG. 4 is a perspective view of the present invention, illustrating its use for performing abdominal exercises.
Figure 6:
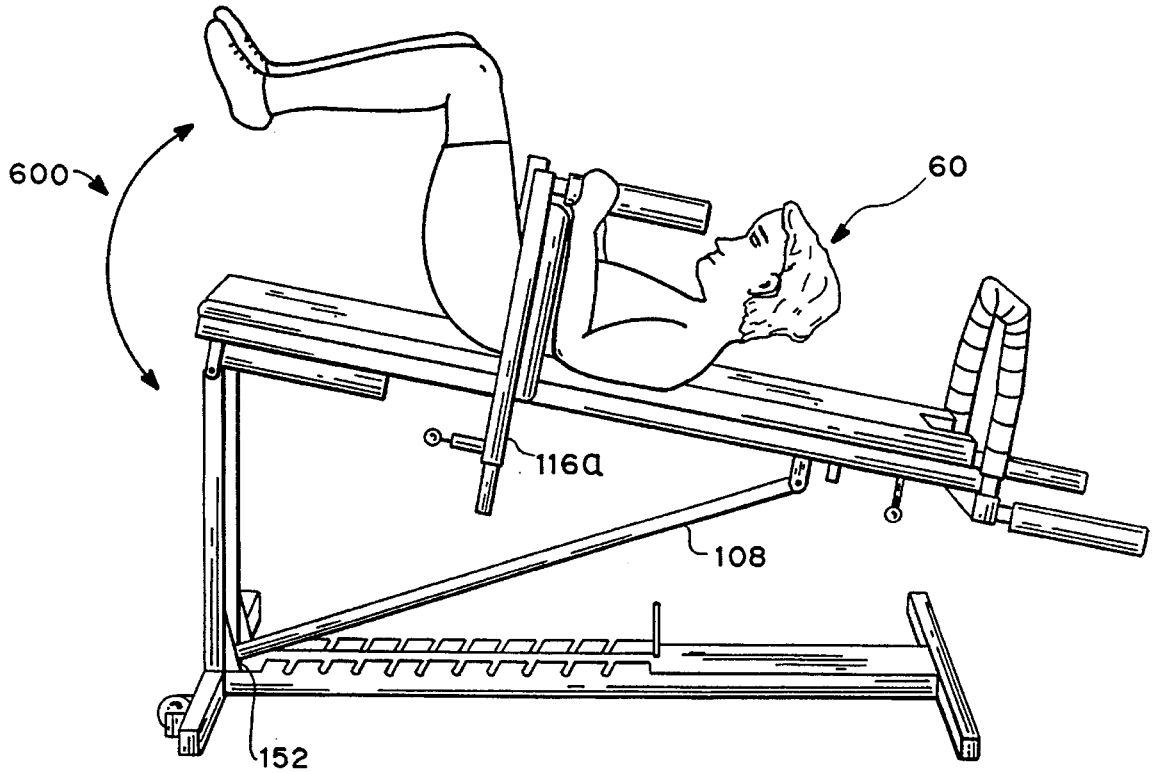
FIG. 6 is a perspective view of the present invention, illustrating its use for performing decline position exercises.
Figure 9:
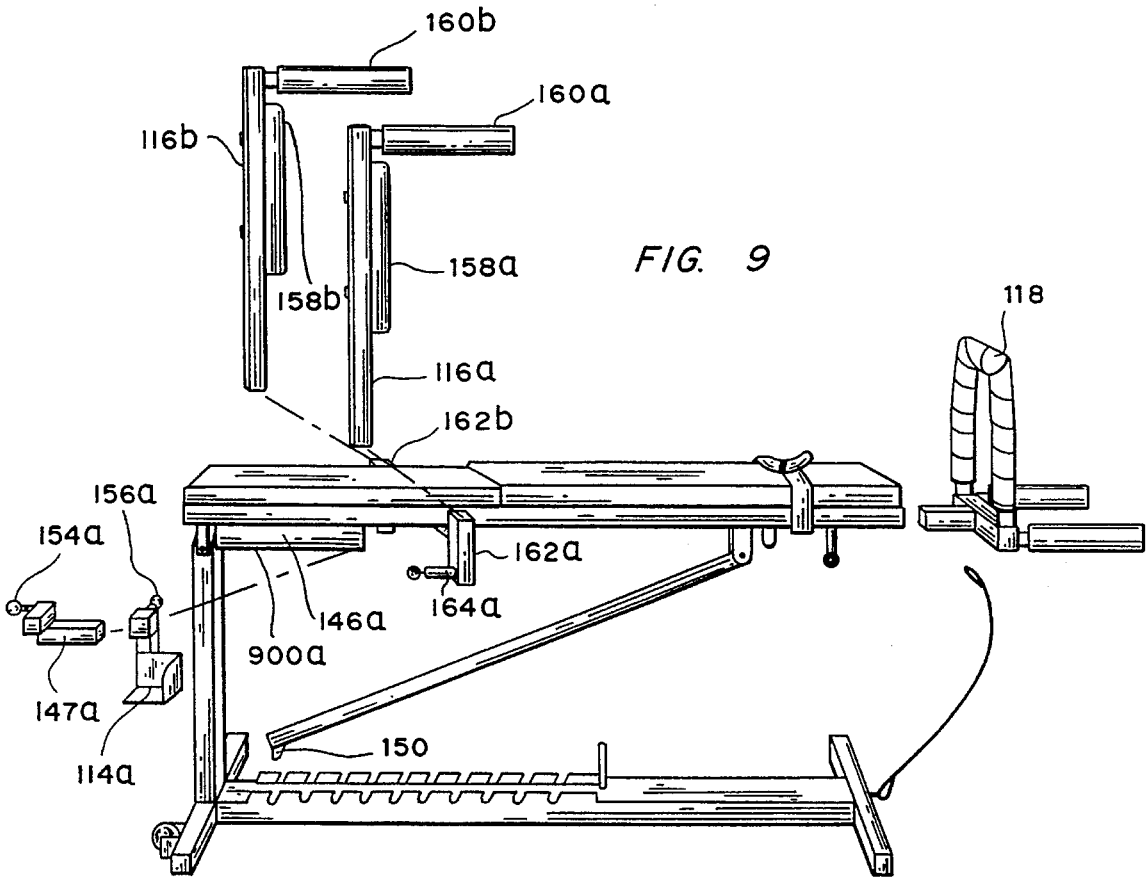
FIG. 9 is an exploded side perspective view of the preferred embodiment of the present invention.
Figure 10:
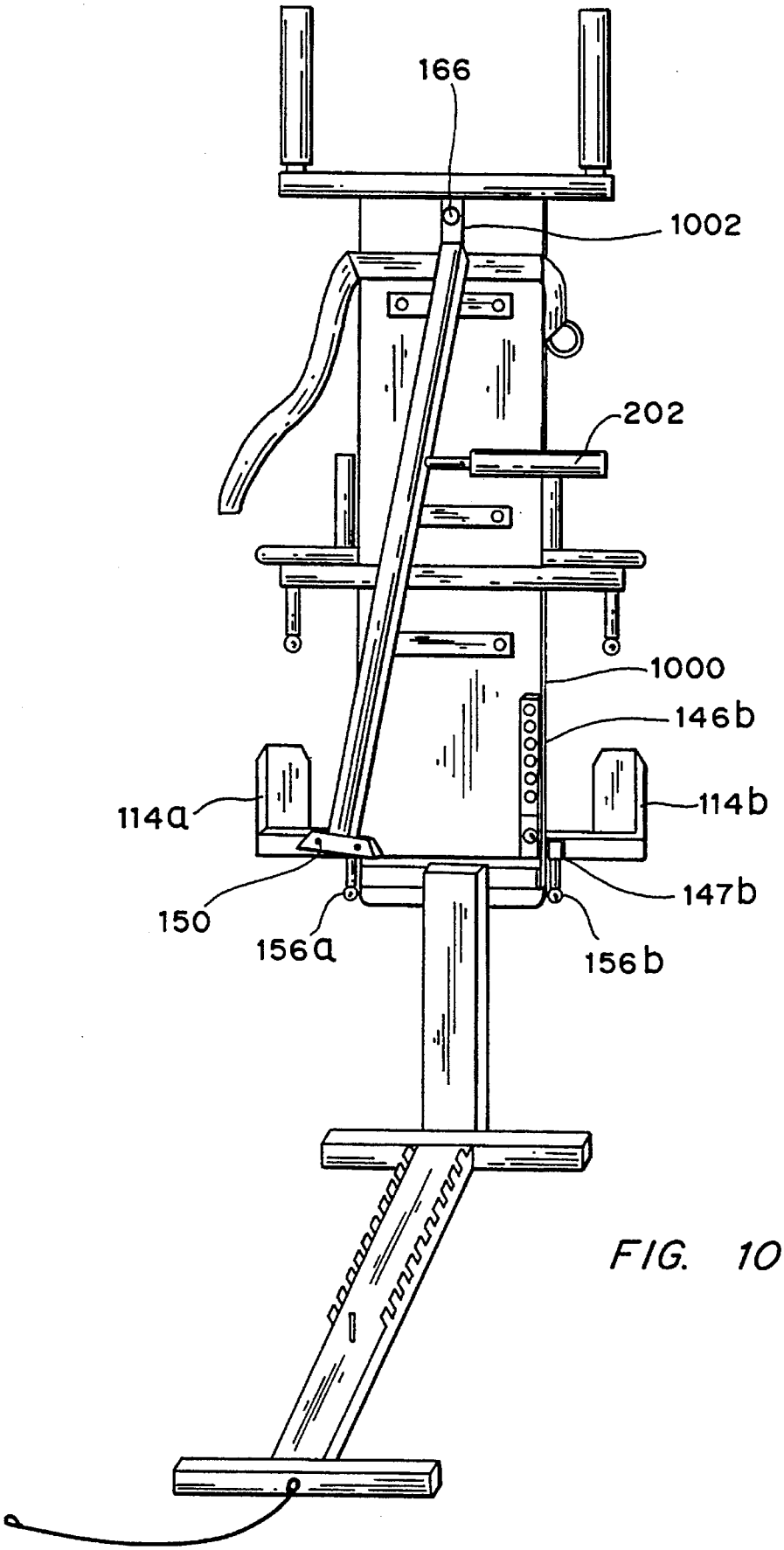
FIG. 10 is a perspective view of the preferred embodiment of the present invention.

A bench height adjustment bar 108 is pivotally attached at fastener 168 to bench 104. A bench height positioning means 122 for accommodating end 150 of bench height adjustment bar 108 is provided on base 102. In the preferred embodiment of the present invention, bench height positioning means 122 is a series of spaced notches wherein end 150 is engaged in a notch in order to position bench 104 in a horizontal position or varying inclining exercise positions, as shown in FIGS. 2, 4, and 5. In the preferred embodiment, the bench height positioning means will include a post 124 and a point 152. Maximum incline of bench 104 is achieved by placing end 150 over post 124. For all the exercises illustrated, the greater the incline of bench 104, the greater will be the resistance to exercise movement, and therefore the exercise will be more difficult to perform. Bench 104 can be positioned in a declining position by placing end 150 at 152, as shown in FIG. 6. It is preferred that end 150 is flared as shown in FIGS. 9 and 10 to engage bench height positioning means 122.

A feet restraining means comprises a first foot cup **114*a* and a second foot cup 114*b* movably attached at the foot end of bench 104. The detailed construction of foot cup 114*a* is described with reference to FIG. 9. A sliding member 147*a* fits over adjustment bracket 146*a*, and is secured in a desired position by means of a locking knob 154*a* inserted into one of a plurality of positioning holes at 900*a* in the underside of adjustment bracket 146*a*. Foot cup 114*a* fits over sliding member 147*a* as shown in FIG. 9, and is secured in a desired position along sliding member 147*a* by means of locking knob 156*a*. Knob 156*a* is inserted into one of a plurality of holes 700*a*, shown in FIG. 7. Adjusting sliding member 147*a* along adjustment bracket 146*a* allows adjusting the foot cup according to the leg length of an exerciser so as to be positioned comfortably relative to the exerciser. Foot cup 114*a* and sliding member 147*a* are shown in relation to one another in FIG. 2. Adjusting foot cup 114*a* along sliding member 147*a* allows moving the foot cup perpendicular to the bench, thereby allowing the space between the foot cups to be widened or narrowed, depending upon the size of the exerciser, as shown in FIG. 2. The construction of foot cup 114*b* and its corresponding parts 146*b*, 147*b*, 154, and 156*b*, is identical to that of foot cup 114*a*** and is adjustable in the same manner.

An overhead hand grip 118, including a pair of handles 144 is located at the head end of bench 104. It is preferred that overhead hand grip 118 be covered with a tape or foam to make it more comfortable to the hands of an exerciser and less slippery when gripped. The preferred embodiment of the invention will include a foot strap 120 for snugly securing the feet of an exerciser when performing situps to exercise abdominal muscles. FIG. 1 illustrates an exerciser 10 performing situps on a horizontal bench 104, with his feet held in place by strap 120. Foot strap 120 may be used by an exerciser performing situps with bench 104 in the declining and inclining positions as well. In the preferred embodiment of the present invention, strap 120 is comprised of a VELCRO® material or other suitable material known to those skilled in the art.

An upper torso support means comprises a first upper torso support **116*a* and a second upper torso support 116*b* as shown in FIG. 1. The upper torso supports are intermediate foot cups 114*a* and 114*b* and overhead hand grip 118 on bench 104. Detailed construction of upper torso support 116*a* and upper torso support 116*b* is shown in FIG. 9. Forearm pad 158*a* and forearm pad 158*b* are positioned on upper torso support 116*a* and upper torso support 116*b*, respectfully, so as to accommodate the forearms of an exerciser. Upper torso supports 116*a* and 116*b* further comprise hand grip 160*a* and hand grip 160*b*, respectively. When performing certain exercises, an exerciser will position his forearms against forearm pads 158*a* and 158*b* and grip hand grips 160*a* and 160*b*** to support his upper torso in a comfortable position.

Upper torso supports **116*a* and 116*b* can be raised or lowered to accommodate the forearm length of an exerciser by means of torso support bracket 162*a* and 162*b*, respectively. The manner in which an upper torso support is adjusted is described with reference to upper torso support 116*a*, however, both upper torso supports are adjusted in the same manner. Upper torso support 116*a* is adjusted by positioning the support in torso support bracket 162*a* and engaging locking knob 164*a* in the desired one of a plurality of holes 804***a* shown in FIG. 8. The upper torso supports can be raised or lowered with respect to bench 104.

Figure 11:
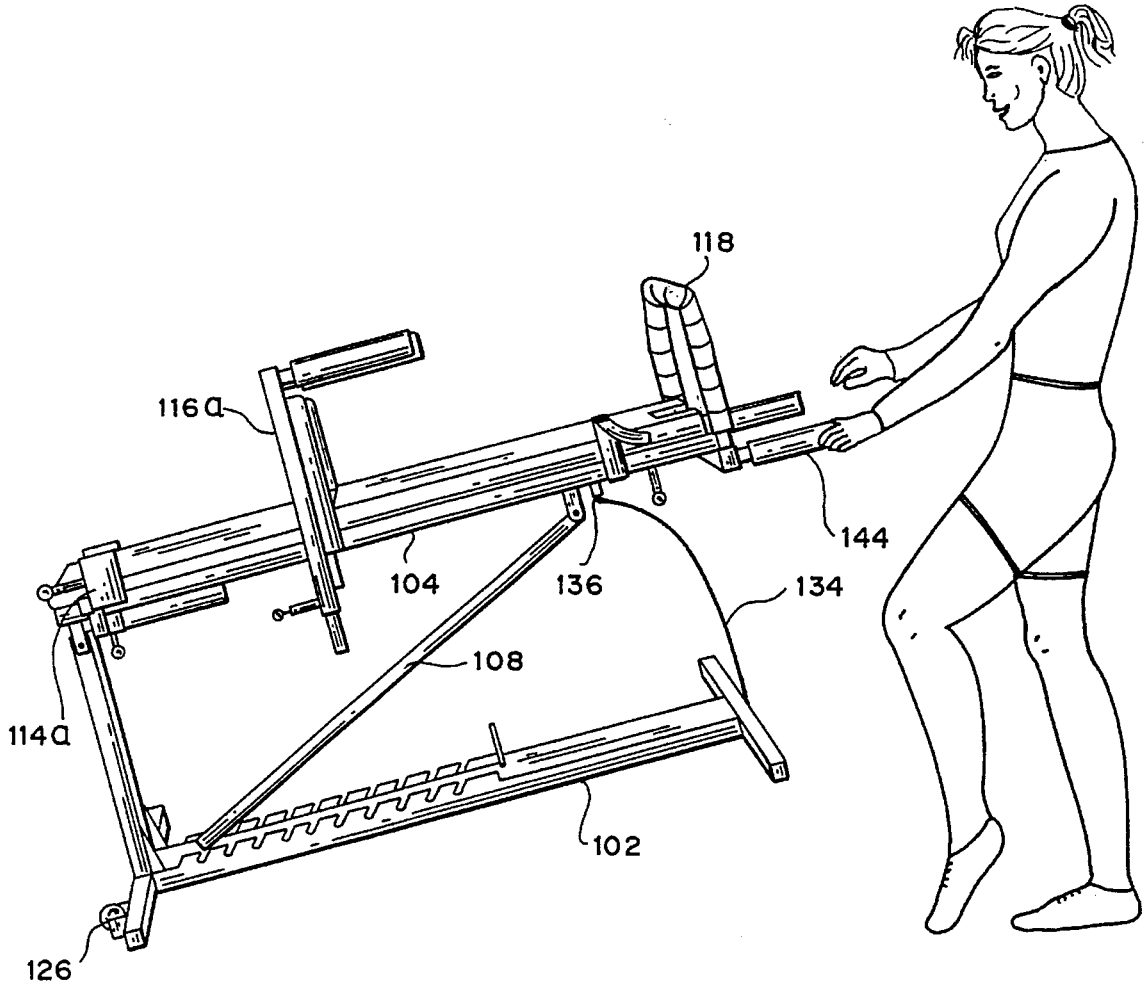
FIG. 11 is a perspective view of the preferred embodiment of the present invention.

In the preferred embodiment, base 102 is I-shaped, having a first terminal cross bar 132 and a second terminal cross bar 130. A cable 134 is affixed to second terminal cross bar 130. A plurality of rollers 126 are affixed to first terminal cross bar 132. Cable 134 may be attached to hook 136 as shown in FIG. 11, thereby securing bench 104 to base 102 so that the apparatus can be easily lifted by handles 144 and moved by rolling the exercise apparatus on rollers 126.

Referring to FIG. 2, an exerciser 20 is shown performing an abdominal and lower back muscle strengthening exercise. The movement of an exerciser 20 follows the arc of arrow 202. Foot cups 114*a* and 114*b* are shown adjusted away from bench 104, thereby not interfering with the leg movements of exerciser 20 when performing the exercise illustrated. Bench 104 in an inclined position in FIG. 2. The steepness of the incline of bench 104 is easily adjusted by any exerciser by lifting bench 104 with one hand using one of the pair of handles 144 and using bench height adjustment bar handle 204 with the other hand to position end 150 of bench height adjustment bar 108 in bench height adjustment means 122, or over post 124. An exerciser may also position bench 104 in a declining position by positioning end 150 of bench height adjustment bar 108 at 152.

Figure 3:
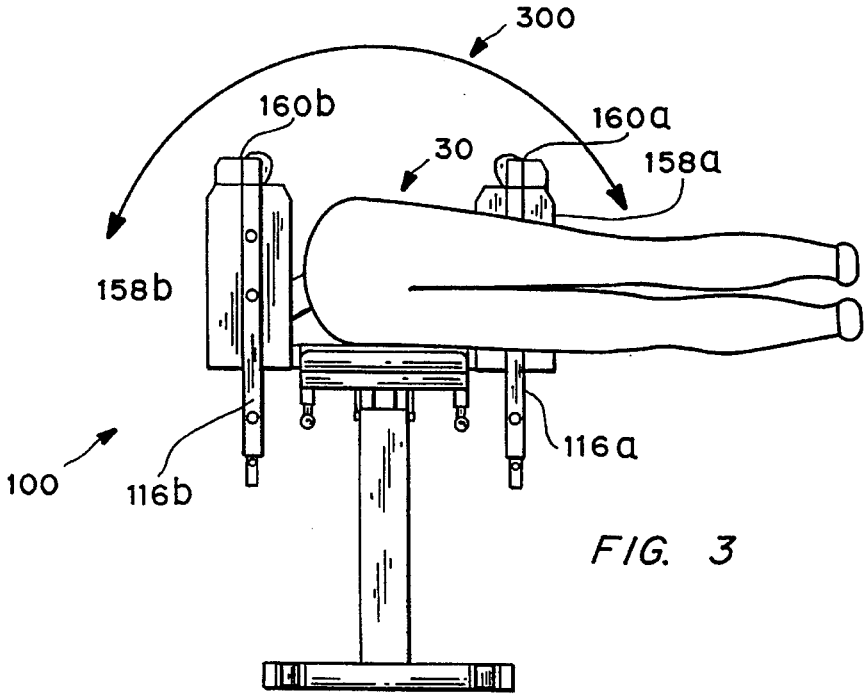
FIG. 3 is a front elevation view of the present invention, illustrating its use for performing lower back and abdominal muscle exercises.

An exerciser can easily position himself on bench 104 as shown in FIG. 3. Foot cups 114*a* and 114*b* can be used to restrain the exerciser from sliding downward on an inclined bench while he is preparing to grip overhead hand grip 118. Upper torso supports 116*a* and 116*b* can be removed, as shown in FIG. 5, if necessary or desired by an exerciser. The exercise illustrated in FIG. 2 may also be performed with bent knees, with one leg crossed over the other leg in a straight or bent position, or in other manners which will enable beneficial exercise movements for working the abdominal and lower back muscles. All exercises illustrated herein are exemplary and may be performed by altering leg positions or making other modifications apparent to those familiar with exercise methods and techniques.

Referring now to FIG. 3, the use of apparatus 100 for performing lower back exercise is illustrated. To perform this exercise upper torso supports 116*a* and 116*b* are positioned at a height to accommodate an exerciser's forearm length. The exerciser positions his forearms against upper torso support pads 116*a* and 116*b*, and grips handles 160*a* and 160*b*, as shown. Foot cups 114*a* and 114*b* are shown removed from bench 104 to allow the exerciser to rotate his legs in the direction of arrow 300, thereby exercising lower back muscles.

Referring next to FIG. 4, exerciser 40 is shown performing Roman chair-like exercises to strengthen abdominal and lower back muscles. Exercises can be performed with a straight or bent legs with the exercisers legs following the direction of arrow 400. The exerciser is positioned on bench 104 such that his forearms are supported against forearm pads 158*a* and 158*b* while gripping handles 160*a* and 160*b*. The difficulty of this exercise is increased by positioning bench height adjustment bar 108 along position adjustment means 122 at a point farther away from point 152 and upwardly extending support bar 106. The position of upper torso supports 116*a* and 116*b* are conveniently adjusted as necessary by repositioning and adjustment brackets 162*a* and 162*b* to comfortably accommodate the forearm length of exerciser 40. Foot cups 114*a* and 114*b* are removed from bench 104 to allow unencumbered movement the exerciser's legs.

FIG. 5 illustrates exerciser 50 performing hyperextensions to exercise lower back muscles. To perform this exercise, foot cups 114*a* and 114*b* are adjusted along adjustment bracket 146*a* to accommodate the length of the exerciser's legs with respect to bench 104. The foot cups prevent the exerciser from sliding downward on the board when performing the exercise illustrated. In order to perform this exercise, overhead hand grip 118 is removed from bench 104 by disengaging lock knob 166. Overhead hand grip 118 is shown removed from bench 104 in FIG. 9. Overhead hand grip 118 is then repositioned in adjustment track 1002, shown in FIG. 10. The pair of handles 144 assist the exerciser in climbing on to bench 104 and positioning his feet into the foot cups. The hyperextensions are performed by following the direction of arrow 500. The foot cups may also be used to prevent an exerciser from sliding forward if performing situps while the bench is in the inclined position shown with the exerciser's feet positioned in the foot cups. This is not however, the preferred method by which to perform sit ups using the apparatus of this invention.

Referring to FIG. 6, the exercise apparatus is shown in a position which will enable older persons, persons who have not exercised for a long period of time and persons recovering from various types of injury to exercise their abdominal and lower back muscles. Foot cups 114*a* and 114*b* are removed from bench 104 so that the exerciser can easily position himself on the bench. The declining position of the board assists the exerciser in moving his legs in the direction of arrow 60. The declining position of bench 104 not only reduces the resistance to exercise experienced when the bench is in an inclined and assists the exerciser in performing exercise movements, in that when his legs are at approximately a 90° angle to his knees, the decline causes the exercisers legs and knees to continue moving in the direction of arrow 60. Thus, persons of reduced muscle strength, both in the abdominals and lower back muscles can use the present invention in an exercise program. The position of the apparatus shown in FIG. 6 may also be used by exercisers needing assistance in performing situps. Although not illustrated, the exerciser would be seated on bench 104 in the manner shown in FIG. 1. His feet would be secured in strap 120 to restrain the exerciser while performing situps on the declining bench. Again, the declining position of bench 104 assists the exerciser when performing situps. When the exerciser's back is approximately perpendicular to bench 104, the declining position of the bench assists the exerciser in continuing the motion of the situp in the forward direction, thereby making the exercise particularly easy for those not able to perform incline situps or those overcoming injury to their abdominals.

Figure 7:
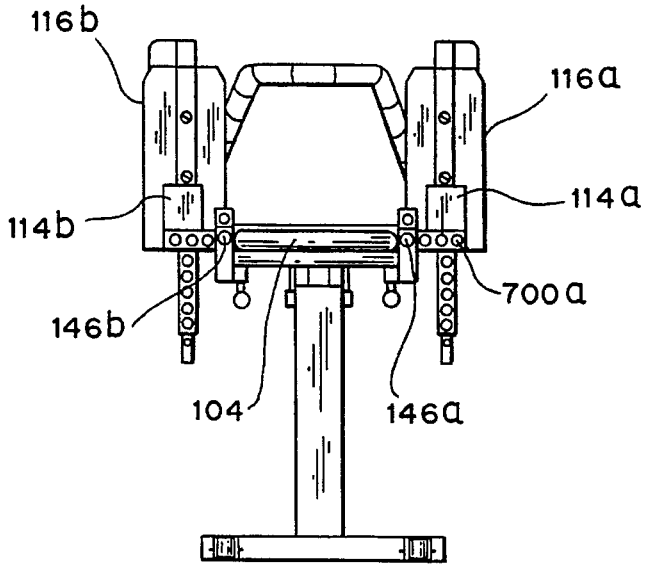
FIG. 7 is a front elevation view of the preferred embodiment of the present invention.
Figure 8:
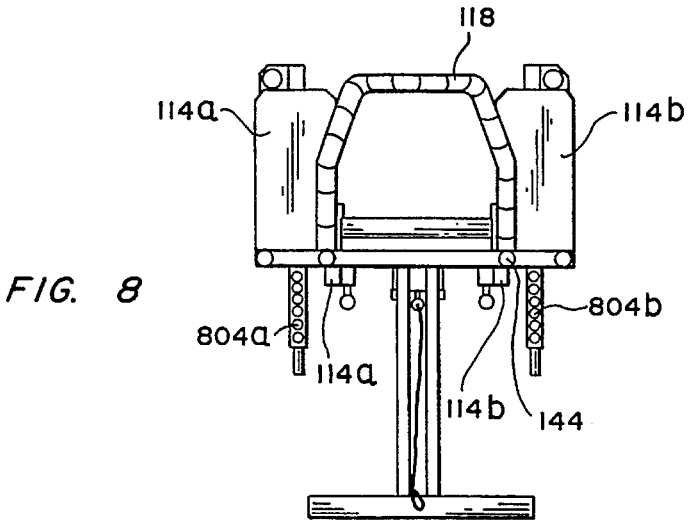
FIG. 8 is a rear elevation view of the preferred embodiment of the present invention.

FIG. 7 and FIG. 8 illustrate foot end and head end elevation views of the invention, respectively. FIG. 7 shows the positions of foot cups 114*a* and 114*b*, upper torso supports 116*a* and 116*b*, and overhead hand grip 118 relative to the foot end of bench 104. FIG. 8 shows the positions of the same components relative to the head end of bench 104.

The detailed construction of apparatus 100 is shown in FIG. 9. The construction of apparatus 100 is of standard materials known to those in the art or of other lightweight materials strong enough to support the weight of an exerciser. The principal structural members of apparatus 100 are preferably fashioned from square or rectangular steel tubing, although other steel shapes and members or other materials may also be employed.

FIG. 10 further illustrates the construction of apparatus 100. Upwardly extending support bar 106 is secured to base 102 by welding or other conventional fastening means. For purposes of shipping or storing apparatus 100, bench height adjustment bar 108 can be removed from bench 104. Bench pads 110 and 112 may also be removed from bench 104. Bench 104 may be separated from upwardly extending support bar 106 at fastener 138. As described earlier, overhead grip 118, upper torso supports 116*a* and 116*b*, and foot cups 14*a* and 14*b* may all be removed from bench 104.

FIG. 11 demonstrates the ease with which the present invention can be moved by any exerciser. As the apparatus has no heavy weights or other such devices required for performing abdominal and lower back exercises, the apparatus is light weight. Cable 134 secures bench 104 to base 102 so that is does not move when the apparatus is being moved as shown.

As many possible embodiments may be made of the invention without departing from the scope thereof, it is to be understood that all matter herein set forth or shown in the accompanying drawings is to be interpreted as illustrative and not in a limiting sense.

What is claimed is:

1. An exercise apparatus comprising:

a base;

an upwardly extending support bar affixed to one end of the base;

a bench having a foot end and a head end, wherein the foot end of the bench is pivotally connected to the upwardly extending support bar;

a foot restraint removably attached to the foot end of the bench;

an overhead hand grip removably attached to the head end of the bench;

a rigid upper torso support removably attached to the bench intermediate to the foot restraint and the overhead hand grip, the upper torso support capable of supporting the body weight of an exerciser through contact with the exerciser's arms;

a bench height positioning device; and a bench height adjustment bar pivotally connected at one end to the bench, wherein a free end of the bench height adjustment bar may be engaged in the bench height positioning device for positioning the bench such that the bench may be secured in inclining, horizontal, and declining positions as desired by the exerciser for performing abdominal and lower back exercises.

2. The exercise apparatus of claim 1, further comprising a strap near the head end of the bench for securing an exerciser's feet.

3. The exercise apparatus of claim 1, wherein the overhead hand grip further comprises a pair of handles.

4. The exercise apparatus of claim 1, wherein the upper torso support further comprises a first and second upper torso support, each upper torso support having a forearm pad and a hand grip.

5. The exercise apparatus of claim 1, wherein the base further comprises a means for rolling the apparatus.

6. The exercise apparatus of claim 1, wherein the base further comprises a plurality of rollers at one end of the base.

7. The exercise apparatus of claim 1, wherein the base is I-shaped.

8. The exercise apparatus of claim 1, wherein the base further comprises a means for securing the bench to the base when the exercise apparatus is moved.

9. The exercise apparatus of claim 1, wherein the base further comprises a cable for securing the bench to the base when the apparatus is moved.

10. The exercise apparatus of claim 1, wherein the bench is padded.

11. The exercise apparatus of claim 1, wherein the bench height positioning device includes a maximum incline adjustment point and a maximum decline adjustment point.

12. The exercise apparatus of claim 1, wherein the bench is removably connected to the upwardly extending support bar.

13. The exercise apparatus of claim 1, wherein the bench height adjustment bar is removably connected to the bench.

* * * * *